US010301088B1

(12) United States Patent
Laible

(10) Patent No.: US 10,301,088 B1
(45) Date of Patent: May 28, 2019

(54) TAMPER-PROOF CONTAINER INSERT

(71) Applicant: Rodney Laible, Omaha, NE (US)

(72) Inventor: Rodney Laible, Omaha, NE (US)

( * ) Notice: Subject to any disclaimer, the term of this patent is extended or adjusted under 35 U.S.C. 154(b) by 0 days.

(21) Appl. No.: 15/864,366

(22) Filed: Jan. 8, 2018

(51) Int. Cl.
*B65D 39/00* (2006.01)
*B65D 51/16* (2006.01)
*B65D 55/02* (2006.01)

(52) U.S. Cl.
CPC ..... *B65D 55/02* (2013.01); *B65D 39/0052* (2013.01); *B65D 51/16* (2013.01)

(58) Field of Classification Search
CPC ..... B65D 55/02; B65D 39/0052; B65D 51/16
See application file for complete search history.

(56) References Cited

U.S. PATENT DOCUMENTS 3,545,475 A * 12/1970 Johnson, Jr. ..... B67D 1/0802 137/212
3,823,848 A * 7/1974 Schuster ..... B65D 39/04 222/400.7
4,386,696 A * 6/1983 Goncalves ..... B65D 51/2871 206/221
4,660,744 A * 4/1987 Csaszar ..... B65D 49/04 137/516.21
4,691,836 A * 9/1987 Wassilieff ..... B65D 47/063 215/294
4,694,975 A * 9/1987 Hagan ..... B67D 1/0456 215/4
5,586,589 A * 12/1996 Voelker ..... B65D 47/24 141/349
5,957,328 A * 9/1999 Osgar ..... B67D 7/344 222/1
5,988,456 A 11/1999 Laible
6,142,345 A 11/2000 Laible
6,189,741 B1 * 2/2001 Behar ..... B05B 11/0013 222/321.7
6,425,502 B1 * 7/2002 Rauworth ..... B65D 1/20 137/212
6,968,983 B2 11/2005 Laible
6,986,444 B2 * 1/2006 Fuchs ..... B05B 11/0013 222/321.7
7,487,951 B2 * 2/2009 Johnson ..... B65D 77/067 141/349
D682,103 S * 5/2013 Jedlicka ..... D9/452
8,544,690 B2 * 10/2013 Garcia ..... B05B 11/0013 222/147
8,870,037 B2 * 10/2014 Takanohashi ..... B67D 7/0266 137/212
9,016,524 B2 * 4/2015 Chisholm ..... B65D 49/02 222/147

(Continued)

*Primary Examiner* — Frederick C Nicolas
(74) *Attorney, Agent, or Firm* — Dennis L. Thomte; Thomte Patent Law Office LLC

(57) ABSTRACT

A tamper-proof insert for use with a closed loop system, a dispensing system, a gravity draining system or other systems. The insert is designed to be inserted into the throat of a container such as a bottle. A retention lug ring is secured to the lower end of the insert. The upper ends of the retention lugs of the retention lug ring engage the inside of the container to prevent the insert from being manually pulled upwardly and outwardly from the throat of the container. If the insert is pulled from the container against the resistance of the retention lugs, the lugs will break-away from the insert and it will be evident that the insert has experienced tampering.

6 Claims, 4 Drawing Sheets

(56) References Cited

U.S. PATENT DOCUMENTS

| | | | | |
|---|---|---|---|---|
| 9,126,725 | B1 | 9/2015 | Laible | |
| 9,242,847 | B1 | 1/2016 | Laible | |
| 9,604,762 | B2 * | 3/2017 | Takanohashi | B67D 7/0266 |
| 2007/0175924 | A1 * | 8/2007 | Lompech | B05B 11/3042 222/321.1 |

* cited by examiner

TAMPER-PROOF CONTAINER INSERT

BACKGROUND OF THE INVENTION

Field of the Invention

This invention relates to a tamper-proof container insert which is press-fitted into the throat of a container which has liquid therein. Even more particularly, this invention relates to a retention lug ring which is secured to the lower end of the insert with the retention lug ring including a plurality of radially spaced-apart retention lugs which extend upwardly and outwardly therefrom and which engage the inside surface of the container to prevent the insert from being pulled upwardly and outwardly from the container. Even more particularly, the retention lugs will break-away from the retention lug ring if the insert is forcefully pulled from the container with the broken lugs being evidence that the insert has been subjected to tampering.

Description of the Related Art

Container inserts are used in closed loop systems such as disclosed in U.S. Pat. Nos. 5,958,456; 6,142,345; 6,968,983; 9,126,725; and 9,242,847. Although the inserts of the above-identified patents work extremely well, it is believed that the container inserts should be tamper-proof by making the inserts extremely difficult, if not impossible, to be removed from the container. If the inserts are not tamper-proof, the inserts could be removed from the container so that the insert and container could be re-used, which is illegal in some jurisdictions.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A tamper-proof container insert is described which is press-fitted into the throat of a container which has liquid therein. The insert is of the mechanical venting type. A horizontally disposed retention lug ring is mounted on the insert at the lower end thereof. The retention lug ring includes a horizontally disposed base ring which is secured to the insert at the lower end of the insert. The retention lug ring has a plurality of radially spaced-apart retention lugs, having upper and lower ends, which extend upwardly and outwardly from the base ring whereby the upper ends of the retention lugs are in engagement with the inside surface of the container which makes it difficult, if not impossible, for the insert to be removed from the container thereby preventing the container or insert from being re-used.

It is therefore a principal object of the invention to provide an improved mechanical venting insert.

A further object of the invention is to provide a tamper-proof insert for a container.

A further object of the invention is to provide an insert for use with a container with the insert having a retention lug ring mounted thereon at the lower end thereof, with the lugs of the retention lug ring engaging the inner surface of the container to make it difficult, if not impossible, to remove the insert from the container.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
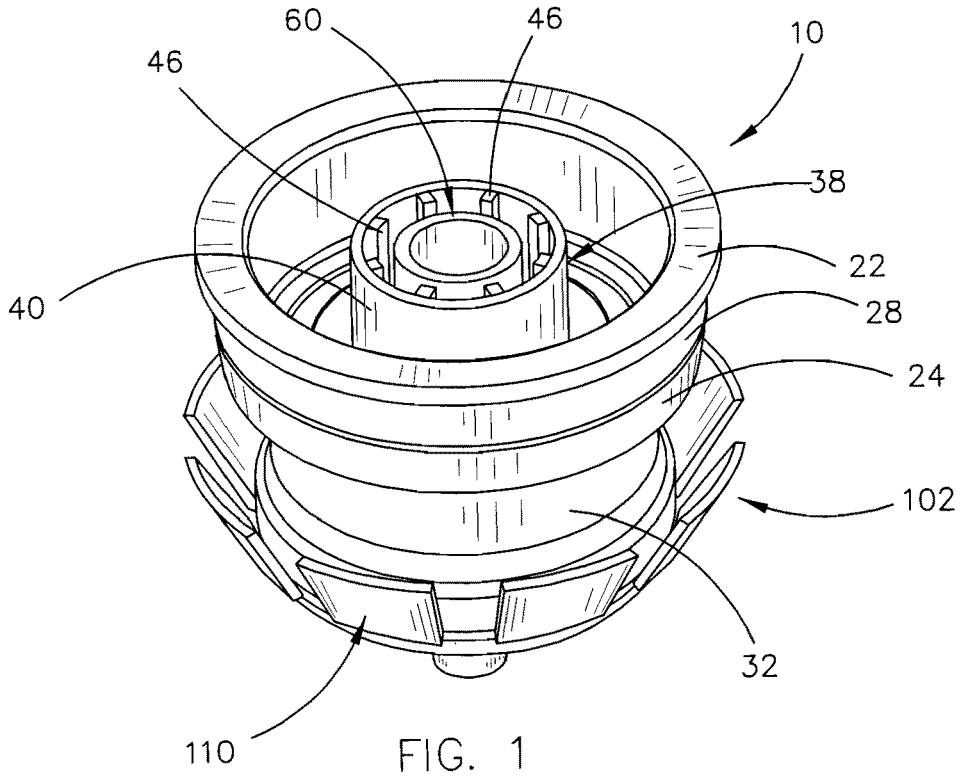
FIG. 1 is an upper perspective view of the tamper-proof container insert of this invention.
Figure 2:
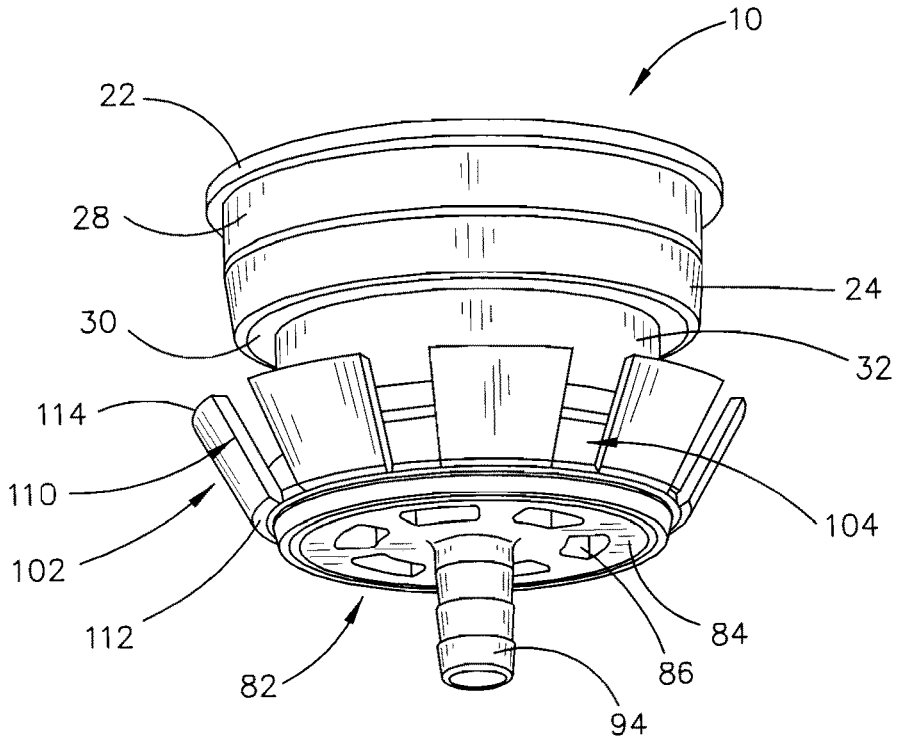
FIG. 2 is a lower perspective view of the tamper-proof container insert of this invention.
Figure 3:
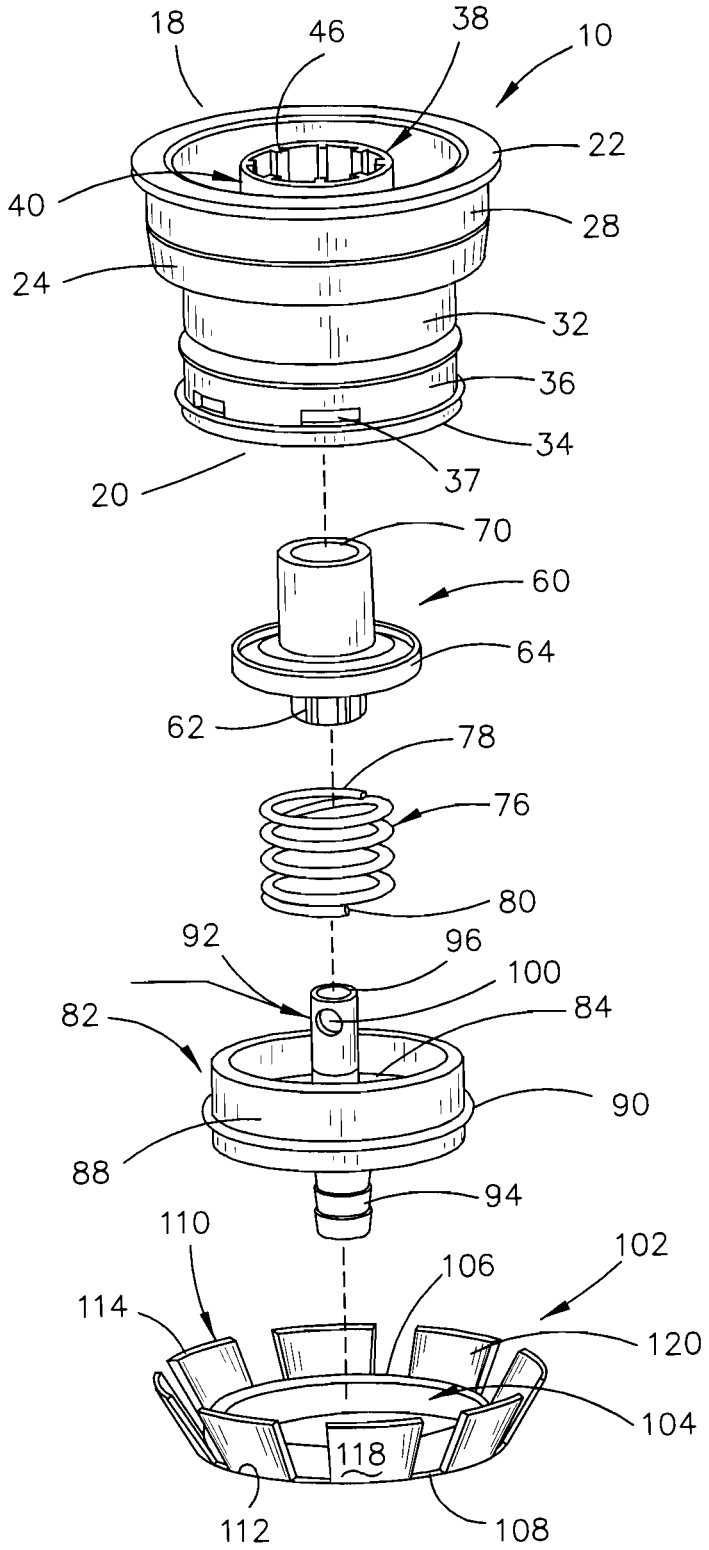
FIG. 3 is an exploded perspective view of the tamper-proof container insert of this invention.
Figure 4:
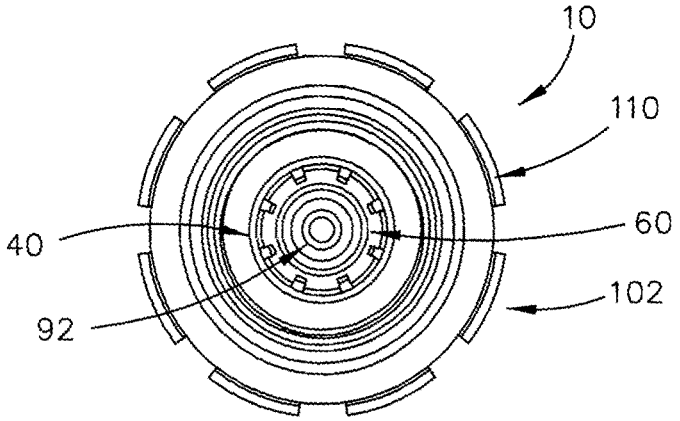
FIG. 4 is a top view of the tamper-proof container insert of this invention.
Figure 5:
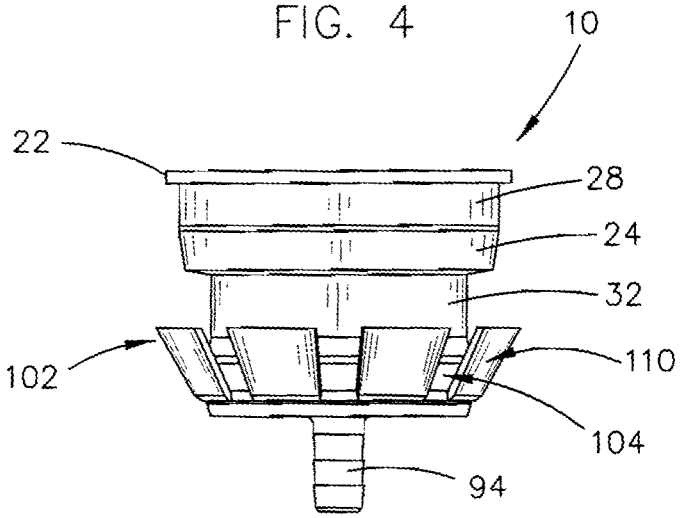
FIG. 5 is a side view of the tamper-proof container insert of this invention.
Figure 6:
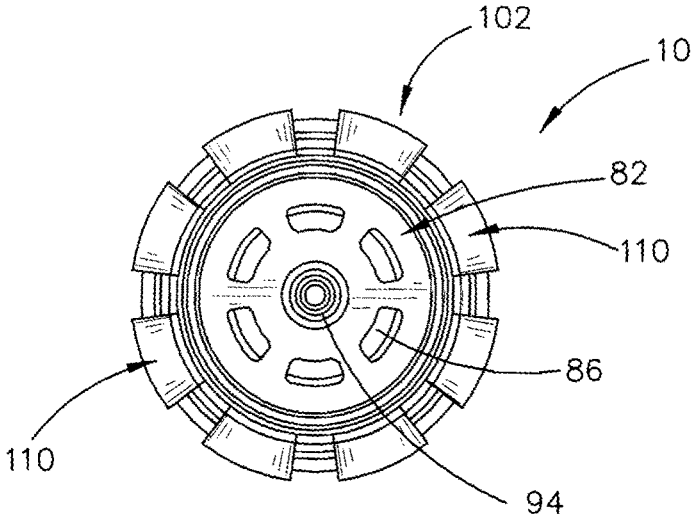
FIG. 6 is a bottom view of the tamper-proof container insert of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The numeral 10 refers to a container insert or throat plug assembly (hereinafter "insert") which is press-fitted into the throat or outlet opening 12 of a container 14 such as a bottle or the like. Preferably, throat opening 12 has external threads 16. Insert 10 includes an open upper end 18 and an open lower end 20. Insert 10 includes a ring-shaped upper flange or lip 22, and a first cylindrical wall member 24, which extends downwardly from the inner end of lip 22. The outer surface of wall member 24 has a cylindrical recess 26 formed therein. A seal 28 is positioned in recess 26 as shown and described in U.S. Pat. Nos. 9,242,847 and 9,126,925, the disclosures of which are incorporated herein by reference thereto to complete this disclosure if necessary.

The lower end of wall member 24 has an inwardly extending lower end, lip or shoulder 30. Wall member 32 extends downwardly from the inner end of shoulder 30 and has a lower end 34. A ring-shaped, cylindrical recess 36 is formed in wall member 32 at the lower end thereof, the purpose of which will described hereinafter. A plurality of radially spaced-apart openings 37 are formed in recess 36.

Insert 10 has a receiver portion 38 integrally molded therein which includes a cylindrical wall or tubular portion 40 having an upper end 42 and a lower end 44. The interior of tubular portion 40 has a plurality of radially spaced-apart ribs 46 protruding inwardly therefrom. A horizontally disposed wall 48 extends inwardly and outwardly from the lower end 44 of tubular portion 40. A ring-shaped wall or rib 50 extends downwardly from the wall 48. A cylindrical wall 52 extends downwardly from the outer end of wall 48 to define a chamber 54. Wall 52 is joined to wall 32 by a shoulder 56. A ring-shaped groove 58 is formed at the lower ends of walls 52 and 32.

The numeral 60 refers to a valve stem or valve which includes a cylindrical lower body portion 62, an annular shoulder portion 64 and a cylindrical upper body portion 66. As seen, the diameter or base 68 of lower body portion 62 is less than the diameter of the base 70 of upper body portion 66. The annular shoulder portion 64 has a ring-shaped groove 72 formed therein which receives the rib 50 as will be described in greater detail hereinafter. Annular shoulder portion 64 has an annular groove or recess 74 formed in the lower side thereof.

Figure 7:
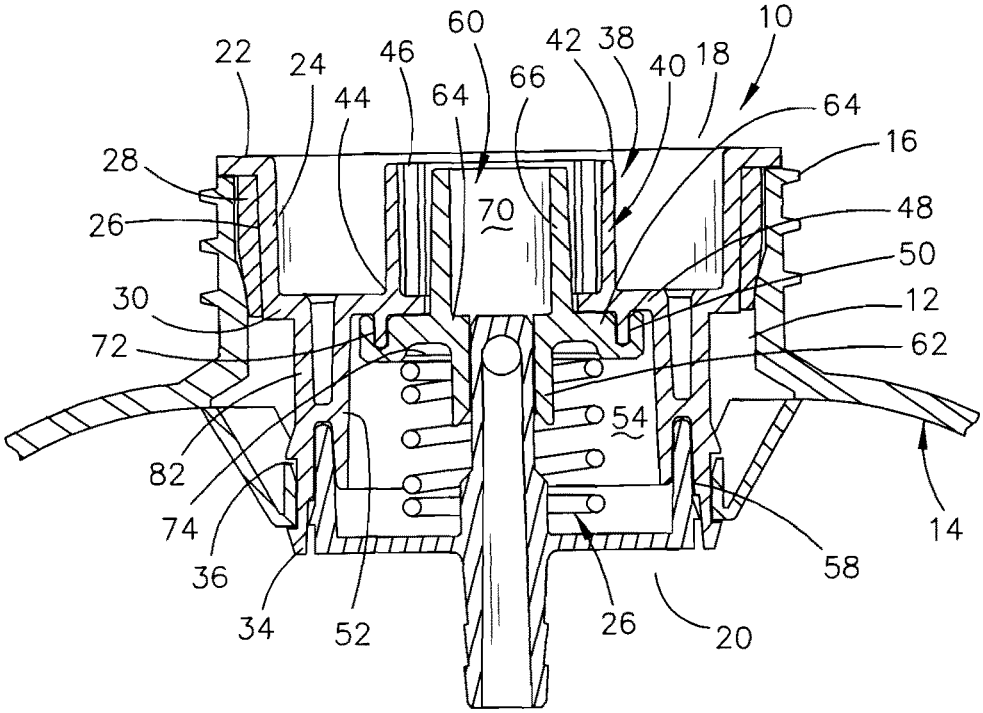
FIG. 7 is a sectional view of the tamper-proof container insert of this invention with the container insert being positioned in the throat of a container and with the valve of the container insert being in a closed upper position to prevent liquid from flowing outwardly through the container insert.
Figure 8:
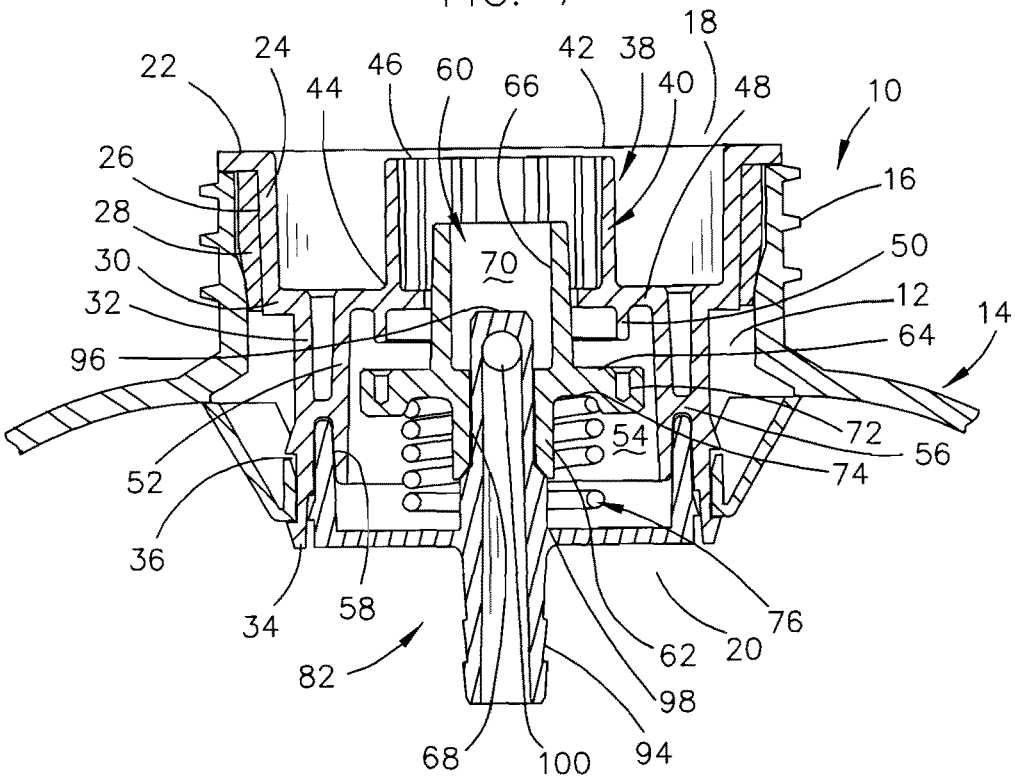
FIG. 8 is a view similar to FIG. 7 except that the valve thereof is opened to permit liquid to flow outwardly from the container therethrough and to permit air to enter the container as liquid is drawn from the container.

As seen in the drawings, valve stem 60 is vertically movably received in receiver position 38. As will be explained hereinbelow, valve stem 60 is movable between an upper position (FIG. 7) to a lower position (FIG. 8). As seen, when valve stem 60 is in its upper position of FIG. 7, the upper end of body portion 68 is positioned slightly below the upper end of tubular portion 40.

The numeral 76 refers to an elongated spring having an upper end 78 and a lower end 80. As seen, the upper end of spring 76 is received in the groove 74 formed in the underside of shoulder portion 74.

The numeral 82 refers to a disc member or retainer having a horizontally disposed bottom wall 84 having a plurality of vent openings 86 formed therein. A ring-shaped side wall 88 extends upwardly from the periphery of bottom wall 84. The outer surface of side wall 88 has an annular rib 90 extending outwardly therefrom. The numeral 92 refers to a hollow valve body which is integrally formed with retainer 82 and which is in communication with the hollow and elongated dip tube support 94 which extends downwardly from bottom wall 84. Valve body includes an upper end 96 and a lower end 98. The upper end 96 of valve body 92 is closed as seen in the drawings. The side wall of valve body 92, below the upper end 96 thereof, has a pair of openings 100 formed therein to permit the liquid being drawn from the container 14, through the dip tube support 94, to pass through the valve body 92, as will be described in detail hereinafter.

The spring 76 is positioned between the annular shoulder 94 and the retainer 82. The retainer 82 is then snap-fitted onto the lower end of tubular portion 40 by inserting the side wall 88 into the groove 58. The retainer 82 is further held in the groove 58 by the rib 90 engaging the inner side of the lower end of tubular portion 40. The spring 76 yieldably maintains the valve stem 60 in its upper position so that the openings 100 in valve body 92 are closed.

The numeral 102 refers to a retention lug ring which includes a horizontally disposed and generally vertically disposed base ring member 104 having an upper end 106 and a lower end 108. Retention lug ring 102 also includes a plurality of radially spaced-apart lugs or flaps 110, each of which have a lower end 112, an upper end 114, an inner side 116 and an outer side 118. The lower ends 112 of lugs 110 are molded to the lower end of base ring member 104 and extend upwardly and outwardly therefrom.

The retention lug ring 102, which is comprised of a plastic material, is secured to the insert whereby the base ring member 104 is received in the recess 36 of wall member 32. When the insert 10 is positioned in the throat 12 of container 14, the upper ends 114 of lugs 110 engage the inner surface of container 14 as seen in FIGS. 7 and 8. The retention lug ring 102 resists any upward movement of the insert 10 with respect to the container 14 thereby making it extremely difficult, if not impossible, to remove the insert 10 from the container. Thus, the insert is tamper-proof. When the insert 10 is mounted in the throat 12 of the container 14, the spring 76 will yieldably maintain the valve 60 in its upper position of FIG. 7. In the upper position of FIG. 7, the openings 100 in valve body 92 will be closed. In the upper position of valve 60, venting of the container 14 is not possible due to the rib 50 being received in the groove 72 and due to the engagement of the annular shoulder portion 64 with the upper side of wall 48.

When liquid in the container 14 is to be withdrawn, the valve 60 will be moved downwardly to the lower position of FIG. 8 by structure such as disclosed in the above-identified patents. When valve 60 is in its lower position of FIG. 8, the openings 100 in valve body 92 will be open so that liquid may be drawn upwardly through the dip tube mounted on dip tube support 94, through valve body 92 into bore 70 of upper tubular member 66 and outwardly therefrom.

When the valve 60 is in the lower position of FIG. 8, air may be vented into the container 14 as will now be described. Venting air in tubular portion 40 may move downwardly in the insert 10 between the outer side of wall 66 and the inner side of wall 48, thence downwardly therefrom, and through the vent openings 86 into the container 14.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. An insert for use with a closed loop dispensing system including a container having a throat with an inside surface, comprising:

- a horizontally disposed ring-shaped lip having an upper side, a lower side, an outer end, and an inner end;
- a cylindrical first wall member having an open upper end, an open lower end, an inner surface and an outer surface;
- said first wall member extending downwardly from said inner end of said lip whereby said lip protrudes outwardly form said upper end of said first wall member;
- a horizontally disposed first annular shoulder extending inwardly from said open lower end of said first wall member;
- said first annular shoulder having an inner end, an outer end, an upper end and a lower end;
- a vertically disposed and annular second wall member having an upper end and a lower end;
- said second wall member extending downwardly from said inner end of said first annular shoulder;

a vertically disposed tubular receiver having an upper end, a lower end, an inner surface and an outer surface;

a horizontally disposed and annular third wall member having an inner end, an outer end, an upper side and a lower side;

said lower end of said tubular receiver being secured to said third wall member outwardly of said inner end of said third wall member to define a valve stop at said inner end of said third wall member;

said third wall member having a vertically disposed annular rib extending downwardly from said lower side of said third wall member between said inner and outer ends of said third wall member;

a vertically disposed and annular fourth wall member having an upper end and a lower end;

said fourth wall member extending downwardly from said third wall member inwardly of said second wall member;

a vertically disposed and annular groove formed between said lower ends of said second and fourth wall members;

said lip, said first wall member, said first annular shoulder, said tubular receiver, said rib, and said fourth wall member being integrally formed;

an upstanding hollow valve body having an upper tubular member, a lower tubular member, and a horizontally disposed annular shoulder portion extending outwardly between said upper and lower tubular members;

said upper tubular member having a greater diameter than said lower tubular member;

said annular shoulder portion of said valve body having an upper side and a lower side;

said upper side of said annular shoulder portion of said valve body having an annular groove formed therein;

said upper tubular member being vertically movably received in said tubular receiver so as to be movable between an upper position and a lower position;

said annular groove in said upper side of said annular shoulder portion of said valve body receiving said annular rib of said third wall member when said valve body is in said upper position;

said upper side of said annular shoulder portion of said valve body being in sealing engagement with said third wall member when said valve body is in said upper position;

said annular groove in said upper side of said annular shoulder portion of said valve body being vertically spaced from said annular rib of said third wall member when said valve body is in said lower position;

said upper side of said annular shoulder portion of said valve body being spaced from said third wall member when said valve body is in said lower position;

a cylindrical spring having an upper end and a lower end;

said upper end of said spring embracing said lower tubular member of said valve body;

said upper end of said spring being in engagement with said lower side of said annular shoulder portion of said valve body;

a retainer member having a horizontally disposed circular bottom wall having a plurality of vent openings formed therein;

said bottom wall having upper and lower sides;

a ring-shaped side wall, having a lower end, an upper end, an outer surface and an inner surface, extending upwardly from said bottom wall;

said outer surface of said ring-shaped side wall having an annular rib extending outwardly therefrom;

an elongated hollow valve body, having a closed upper end and a open lower end, integrally formed with said bottom wall and extending upwardly therefrom;

said hollow valve body member having a plurality of openings formed therein below said upper end thereof;

a hollow dip tube support, having upper and lower ends, extending downwardly from said lower end of said hollow valve body member and being in fluid communication with open lower end of said hollow valve body member;

said upper end of said side wall of said retainer member being secured to said lower ends of said second and fourth wall members whereby said upper side of said bottom wall of said retainer is in engagement with said lower end of said spring;

said insert preventing fluid flow from said container when said valve body is in said upper position;

said insert permitting fluid flow from said container when said valve body is in said lower position;

said insert permitting ambient air to pass therethrough into said container when said valve body is in said lower position;

and a locking ring secured to said second wall member which engages the inside surface of said container to prevent said insert from being removed from said container.

2. The insert of claim 1 wherein said upper end of said ring-shaped side wall of said retainer is received in said groove at said lower ends of said second and fourth wall members.

3. The insert of claim 1 wherein said locking ring is a retention lug ring.

4. The insert of claim 1 wherein said outer side of said second wall member has an annular recess formed therein at said lower end of said second wall and wherein said locking ring is positioned in said annular recess.

5. The insert of claim 4 wherein said locking ring includes a base ring which is received in said annular recess and wherein a plurality of flexible lugs extend upwardly and outwardly from said base ring in a radially spaced-apart manner for engagement with the inside surface of said container.

6. The insert of claim 5 wherein said locking ring is comprised of a plastic material.

* * * * *